US007430780B2

(12) United States Patent
Moskovich et al.

(10) Patent No.: US 7,430,780 B2
(45) Date of Patent: Oct. 7, 2008

(54) TOOTHBRUSH

(75) Inventors: Robert Moskovich, East Brunswick, NJ (US); Tanja Langgner, London (GB); Joachim Storz, Zell am See (AT); Thomas Küchler, Schliem (AT)

(73) Assignee: Colgate-Palmolive Company NY (US)

( * ) Notice: Subject to any disclaimer, the term of this patent is extended or adjusted under 35 U.S.C. 154(b) by 0 days.

(21) Appl. No.: 11/053,584

(22) Filed: Feb. 8, 2005

(65) Prior Publication Data

US 2005/0188488 A1 Sep. 1, 2005

Related U.S. Application Data

(63) Continuation of application No. PCT/US03/24978, filed on Aug. 8, 2003.

(60) Provisional application No. 60/402,252, filed on Aug. 9, 2002.

(51) Int. Cl.
*A46B 7/06* (2006.01)
*A46B 9/04* (2006.01)

(52) U.S. Cl. ..... 15/167.1; 15/201

(58) Field of Classification Search ..... 15/167.1, 15/201; D4/104, 105
See application file for complete search history.

(56) References Cited

U.S. PATENT DOCUMENTS

| | | | | |
|---|---|---|---|---|
| 1,698,128 | A | 1/1929 | Funk | |
| 2,706,825 | A | 4/1955 | Blakeman | 15/167.1 |
| 2,882,544 | A * | 4/1959 | Hadidian | 15/167.1 |
| 2,935,755 | A | 5/1960 | Leira et al. | 15/167.1 |
| 3,082,457 | A | 3/1963 | Lucibello et al. | 15/167.1 |
| 3,103,027 | A * | 9/1963 | Birch | 15/110 |
| 3,129,449 | A | 4/1964 | Cyzer | 15/28 |
| D273,635 | S * | 5/1984 | Stocchi | D4/104 |
| D274,018 | S * | 5/1984 | Usui | D4/105 |
| 4,694,844 | A * | 9/1987 | Berl et al. | 15/167.1 |
| 5,325,560 | A | 7/1994 | Pavone et al. | 15/106 |
| 5,355,546 | A | 10/1994 | Scheier et al. | 15/167.2 |
| 5,435,032 | A * | 7/1995 | McDougall | 15/22.1 |
| 5,581,840 | A | 12/1996 | Chen | |
| 5,604,951 | A * | 2/1997 | Shipp | 15/167.1 |
| 5,651,158 | A * | 7/1997 | Halm | 15/167.1 |
| 5,802,656 | A * | 9/1998 | Dawson et al. | 15/110 |
| 5,813,079 | A | 9/1998 | Halm | 15/167.1 |
| 5,946,759 | A * | 9/1999 | Cann | 15/167.1 |
| 6,067,684 | A * | 5/2000 | Kweon | 15/167.1 |
| 6,088,870 | A | 7/2000 | Hohlbein | 15/167.1 |
| 6,219,874 | B1 * | 4/2001 | van Gelder et al. | 15/167.1 |
| 6,832,819 | B1 | 12/2004 | Weihrauch | |
| 2002/0138931 | A1 * | 10/2002 | Davies | 15/167.1 |

FOREIGN PATENT DOCUMENTS

| | | |
|---|---|---|
| EP | 0 274 680 B1 | 12/1991 |
| RU | 2 026 626 C1 | 1/1995 |
| WO | WO 00/4015 | 7/2000 |

* cited by examiner

*Primary Examiner*—Laura C Guidotti
(74) *Attorney, Agent, or Firm*—Michael J. Wallace, Jr.

(57) ABSTRACT

A toothbrush includes a head having multiple cleaning elements. One group of the cleaning elements is flexibly mounted on the head and another group may be fixedly mounted on the head. The flexibly mounted cleaning elements are attached to a flexible membrane so that the membrane is capable of flexing to alter its original orientation during use of the toothbrush and then recover to the original orientation randomly during use.

18 Claims, 3 Drawing Sheets

TOOTHBRUSH

This application is a continuation of application PCT/US2003/024978, filed Aug. 8, 2003, which claims the benefit of U.S. Provisional Application 60/402,252 filed Aug. 9, 2002, both of which are incorporated herein by reference in their entirety.

BACKGROUND OF THE INVENTION

The present invention is directed to a toothbrush, either manual or powered, which includes a handle and a head. Cleaning elements are mounted to the head such as tufts of bristles. When toothpaste is applied to the cleaning elements the user inserts the head into the mouth and brushes the teeth in a known manner.

The head of a conventional toothbrush usually has a flat or slightly altered surface to which cleaning elements are attached. Usually the cleaning elements are strands of plastic material(s) formed into tufts, bundles or other groupings. The strands are attached to the head either before or after forming the toothbrush.

The toothbrush of the present inventor facilitates more motion of cleaning elements in the toothbrush head thereby promoting healthy stimulation of gums. It is well known that the ideal brushing technique from a dental hygiene perspective is an up and down stroke along the vertical surface of teeth which massages the gums while cleaning the teeth. However, due to a number of factors, including ergonomics difficulties, haste, lack of education or the like, few consumers use the recommended brushing technique. Rather, the typical consumer brushes across their teeth in a horizontal motion rather than a vertical movement. Various approaches have been taken by others to translate horizontal brush movement into partial vertical movement of the bristles or cleaning elements.

Translation of horizontal to vertical movement of cleaning elements is accomplished in U.S. Pat. No. 4,783,869 through use of a helix groove in a movable shaft within a toothbrush handle. The groove reserves a pin which rides in the groove. This mechanism causes the toothbrush head to partially rotate or oscillate as the handle moves left-to-right or vice versa in the user's mouth. That rotation or oscillation causes the cleaning elements to move in a vertical plane perpendicular to movement of the toothbrush handle.

The U.S. Pat. No. 5,481,775 discloses an actuate shaped base for a toothbrush head aligned with the longitudinal axis of the head. A movable arcuate block containing cleaning elements is flexibly mounted on the toothbrush head. The block is free to slide on the head in a manner whereby the cleaning elements may travel in a vertical direction generally transverse to the typical side-to-side motion of the toothbrush.

U.S. Pat. No. 5,528,786 discloses pivotal mounting of cleaning elements that allows those elements to move up and down in concert with a side-to-side stroke along the teeth.

A general disclosure of flexible mounting for cleaning elements on a toothbrush head is contained in U.S. Pat. No. 5,839,149. In this partial the cleaning elements are mounted on a flexible membrane supported between a horseshoe shaped handle extension.

U.S. Pat. No. 2,083,217 issued Jun. 8, 1937 to E. I. Brothers, et al. discloses two or three circular brush sections which are arranged within cups 5 and 5' that may be screwed into mating receptacles in the tooth brush handle so that they can be removed and replaced as needed (page 2, lines 52-70). Each brush section contains stiff cleaning elements and is spaced from the other along the longitudinal axis of the handle at a distance less than the thickness of a tooth so that the brush operates on both the lingual (inside) and facial (outside) surfaces of the teeth (page 2, column 1, line 71 to column 2, line 9).

Blakeman U.S. Pat. No. 2,706,825 issued Apr. 26, 1955 discloses a replaceable bristle head for a toothbrush. The flexible head undulates in a manner so that rows of bristles move in a direction aligned with the axis of the toothbrush handle.

U.S. Pat, No. 5,355,546 issued Oct. 18, 1998 and U.S. Pat. No. 5,839,149 issued on Nov. 24, 1998, both to Scheirer et al disclose cleaning elements mounted on a flexible membrane supported between a horseshoe shaped handle extension.

U.S. Pat. No. 6,219,874 B1 issued Apr. 24, 2001 to Gelder, et al. discloses flexible mounting of toothbrush cleaning elements accomplished by segmenting portions of the toothbrush head which segments are connected by flexible hinges.

U.S. Pat. No. 6,338,176 B1 issued Jan. 15, 2002 to Smith, et al. discloses round sections of cleaning bristles mounted on individual pads that rotate within a toothbrush body. This converts backward and forward motion of the toothbrush into circular motion of the cleaning elements (column 1, lines 11-13). The bristles associated with each pad are of varying height to accommodate irregularities, gaps, pockets and contours in natural tooth formation (column 1, lines 40-45). The rotating cleaning elements can be supplemented with fixed cleaning elements adjacent thereto (FIG. 11; column 5, lines 43-49).

Design Patents illustrating circular groups of cleaning elements are U.S. Pat. Nos. Des. 273,635 issued May 1, 1984 to Stocchi and D450,929S issued Nov. 27, 2001 to Angelina, et al. Another arrangement of three circular groupings of cleaning elements is disclosed in Danish Patent 127,188 dated Sep. 18, 1948.

SUMMARY OF THE INVENTION

This application discloses a toothbrush having multiple groupings of cleaning elements ("islands") uniquely mounted to the head of a toothbrush, which mounting facilitates flexible orientation of those groupings relative to the teeth and gums being cleaned. More particularly, the grouping of cleaning elements are mounted relative to the toothbrush head using a transverse, flexible membrane or web extending from the periphery of the cleaning elements to the sidewalls of the toothbrush head.

This flexible mounting facilitates 360 degree limited angle wobble of the cleaning elements. That, in turn, orients the cleaning element towards the teeth even if the toothbrush head is not angled directly parallel to the user's teeth.

The toothbrush of this invention includes a head in the form of a base having an upstanding wall to create a peripheral frame. A thin resilient membrane or web is mounted within the frame. The membrane or web is capable of flexing to facilitate orientation of the cleaning elements carried by the membrane relative to the teeth of the user.

Preferably, the cleaning elements are bristles secured to the membrane or web by in-molded technology.

Additional cleaning elements can be arranged on the periphery of the "islands" to facilitate cleaning in those areas between the "islands". In a preferred embodiment, these additional cleaning elements are fixedly mounted to the toothbrush head outside the periphery of the membrane or web flexibly holding the "islands" of cleaning elements. This combination of flexible and fixed mounting of cleaning elements provides very effective brushing of teeth.

THE DRAWINGS

DETAILED DESCRIPTION

Figure 1:
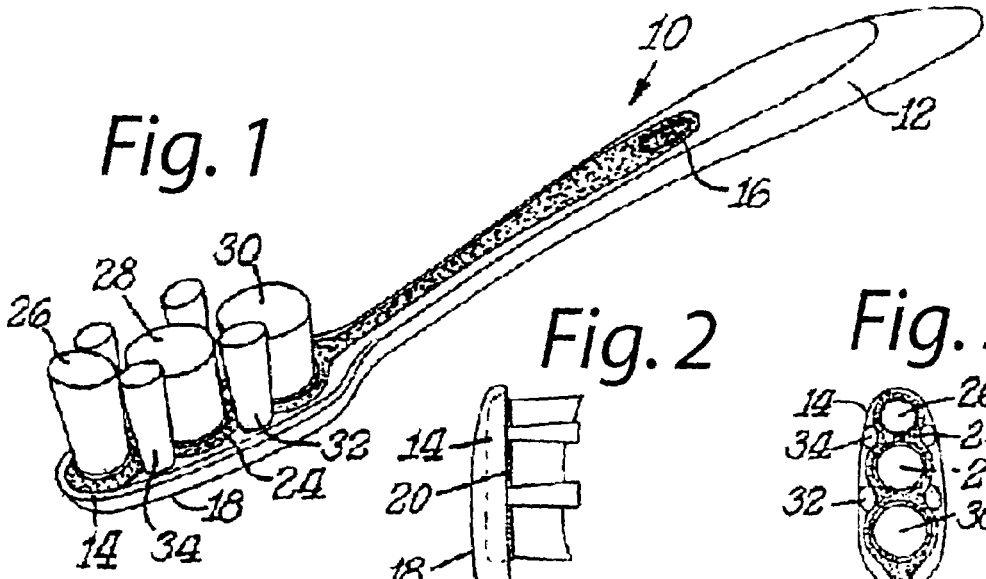
FIG. 1 is a perspective view of a manual toothbrush in accordance with this invention.
Figure 2:
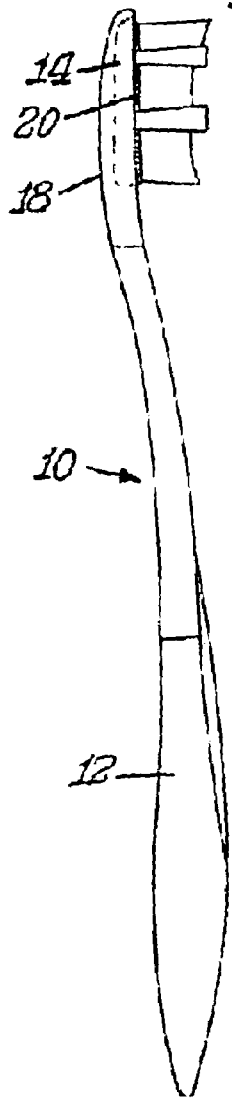
FIG. 2 is a side elevational view of the toothbrush shown in FIG. 1.
Figure 3A:
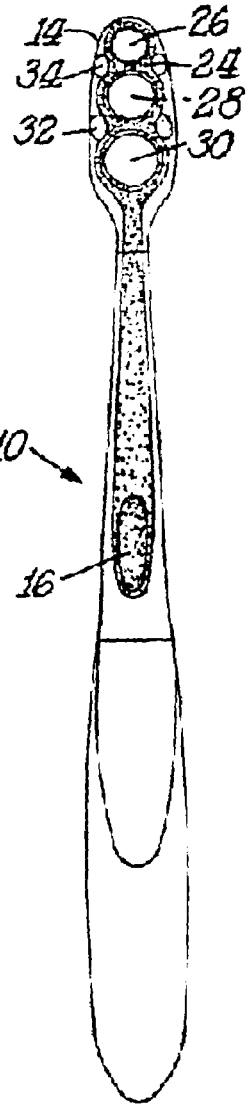
FIG. 3A is a top plan view of the toothbrush shown in FIGS. 1-2.
Figure 3B:
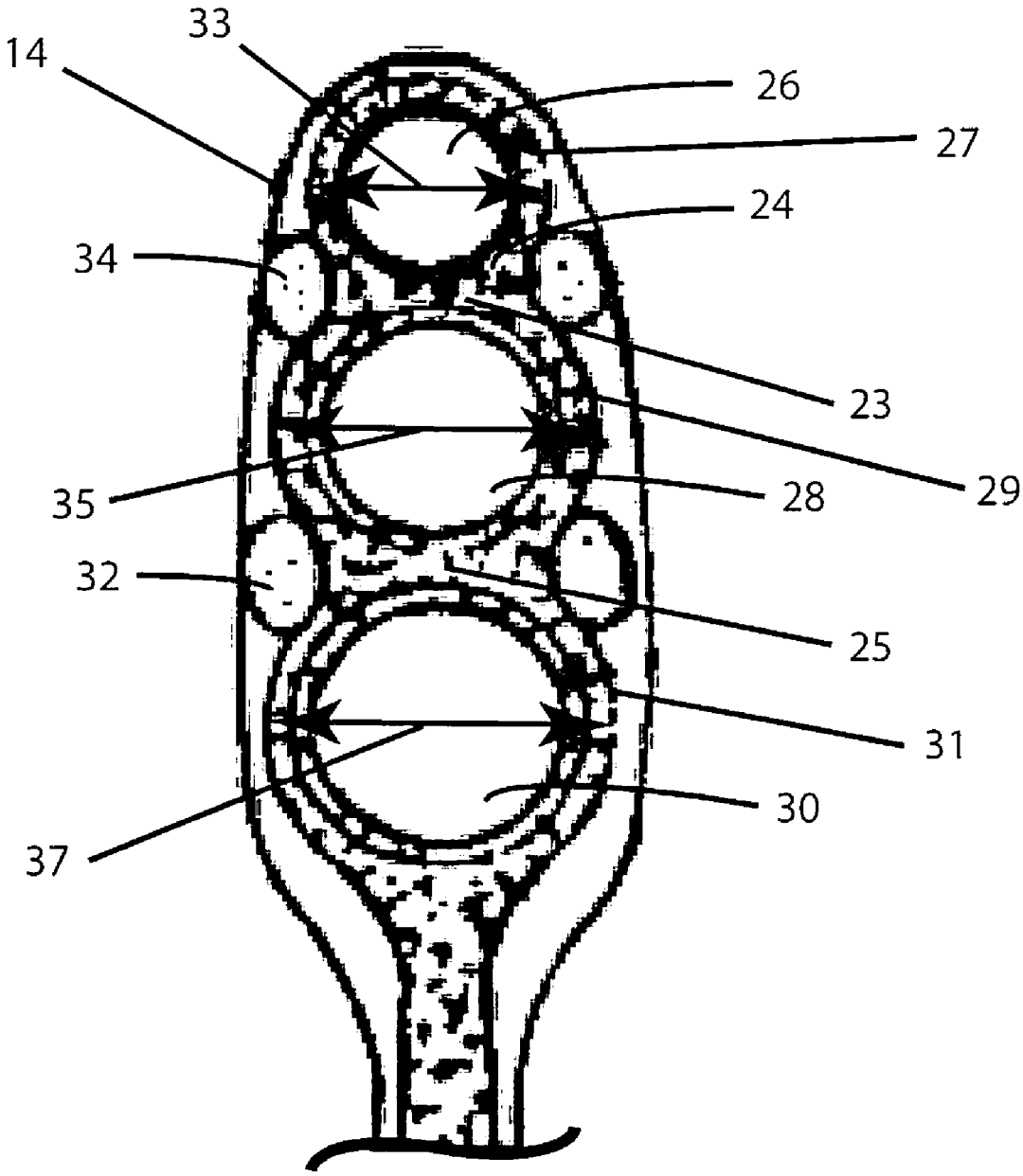
FIG. 3B is a close view of the head of the toothbrush shown in FIG. 3A.

FIGS. 1-3B illustrate a manual toothbrush 10 in accordance with this invention. As shown therein toothbrush 10 includes a handle 12 and a head 14. Handle 12 may include a suitable grip pad 16 made of an etastomeric material. The invention, however, is primarily directed to the arrangement of cleaning elements relative to head 14. As shown in FIG. 2 head 14 has a base portion 18 with an upstanding wall 20 to create a peripheral frame extending above base portion 18. In accordance with this invention a membrane 24 is attached to this frame completely along its periphery. Membrane 24 is preferably an elastomeric material permitting 360 degree movement of the central "islands" of cleaning elements as illustrated in FIGS. 1, 3A and 3B. As illustrated in these FIGS., groups of cleaning elements 26, 28 and 30 are longitudinally aligned in head 14 like islands with some space 23 and 25 between the islands. A flexible web material (not shown) can be used in lieu of membrane 24.

To facilitate tooth cleaning in these spaces between the islands, additional pairs of cleaning elements 32, 34 may be fixedly mounted in head 14 outside the periphery of membrane 24.

The invention is particularly suitable for cleaning elements in the form of strands or bristles attached via in-molded technology (IMT) methods that generally require small cross-sections of material into which the strands are permanently attached. The strands utilizing IMT methods are preferably attached during formation of the toothbrush handle or at least during formation of the head which is the portion of the toothbrush to which the strands and other materials are attached.

The membrane 24 should be a material or combinations of material that can flex to become altered from its original shape and recover to its original shape randomly during brushing. The cleaning elements, for example, bristles, are attached to the flexible membrane creating a flexible orientation of cleaning elements 26, 28 and 30 and by doing so improve the cleaning of the teeth. The moving bristle strands have more degrees of motion than other toothbrushes and thus represent a different and unique tooth brushing device.

In the illustrated embodiment of this invention the head 14 is generally oval in shape and the membrane 24 has a pinched waist shape corresponding to, but displaced from, the periphery of flexible mounted cleaning elements 26, 28 and 30; See FIGS. 3A and 3B. The pinch waist shape thus creates a plurality of interconnected generally circular aligned sections 27, 29 and 31 of progressively uniformly decreasing size toward the distal tip of head 14 carrying the cleaning elements 26, 28 and 30, which, as shown in FIGS. 3A and 3B, have widths 33, 35 and 37 extending in a transverse direction of the head of progressively uniformly decreasing size toward the distal tip of head 14.

The flexible cleaning elements 26, 28 and 30 are complemented by fixed cleaning elements 32 and 34 generally aligned in pairs in the spaces 23 and 25 between the flexible cleaning elements (See FIGS. 3A and 3B). In a preferred embodiment of this invention, the fixed cleaning elements 32, 34 are longer than the flexible cleaning elements. This configuration of flexible and fixed cleaning elements maximizes the cleaning power of this toothbrush.

Any suitable form of cleaning elements may be used as the cleaning elements 26, 28, 30, 32 and 34 in the broad practice of this invention. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block and below membrane 24.

It is to be understood that the specific illustration of the cleaning elements is merely for exemplary purposes. The invention can be practiced with various combinations of the same or different cleaning element configurations (such as stapled or in-molded technology bristles, anchor free technology (AFT), etc.) and/or with the same bristle or cleaning element materials (such as nylon bristles, spiral bristles, rubber bristles, etc.) Similarly, while FIG. 2 illustrates the cleaning elements to be generally perpendicular to head 14, some or all of the cleaning elements may be angled at various angles with respect to the outer surface of head 14. It is thereby possible to select the combination of cleaning element configurations, materials and orientations to achieve specific intended results to deliver additional oral health benefits, like enhanced cleaning tooth polishing, tooth whitening and/or massaging of the gums.

Handle 12, including head 14, is preferably made of hard plastic material which is used for manual toothbrushes. As noted, however, a feature of this toothbrush is use of a flexible resilient membrane 24, such as an elastomer capable of being moved from its original position and then returning to that original position.

Membrane 24 may be secured to the wall 20 of head 14 in any suitable manner. Thus, for example, wall 20 includes inwardly inclined surfaces for receiving membrane 24. Other structural arrangements may be used within the practice of this invention to mount membrane 24 on head 14.

This invention may also be practiced where the head 14 includes one or more power or electrically operated movable sections carrying cleaning elements.

Figure 4:
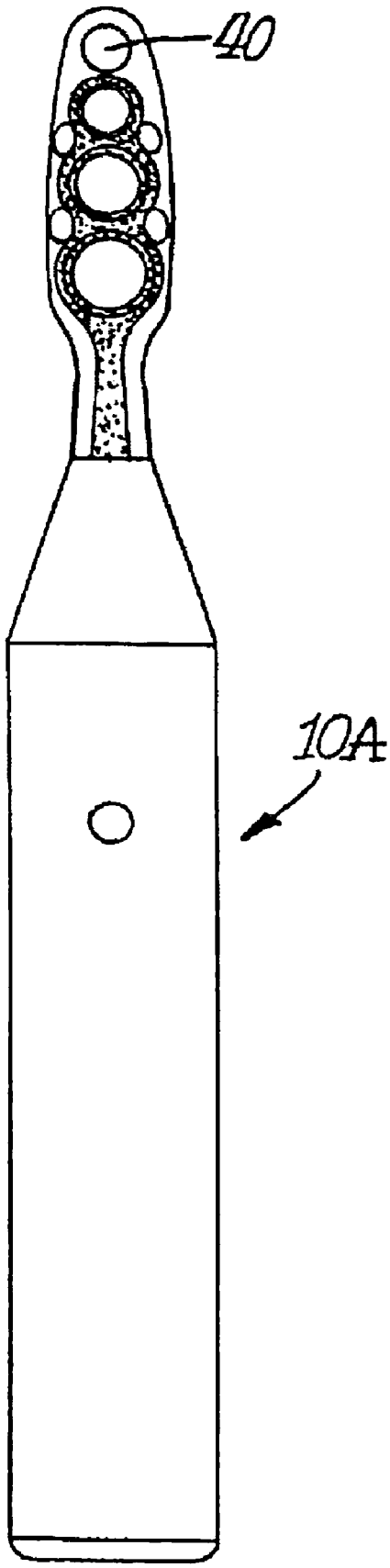
FIG. 4 is a top plan view of a powered toothbrush in accordance with this invention.

FIG. 4 illustrates a toothbrush 10A which includes a power driven movable disc or section 40 having cleaning elements. The movable section 40 could be oscillated rotationally such as by using the type of drive mechanism shown in U.S. Pat. No. 5,625,916, or could move in and out using the type of drive mechanism shown in U.S. Pat. No. Re35,941; all of the details of both patents are incorporated herein by reference thereto. Alternatively, the other types of drives referred to above could move section 40 in other manners and directions. Although FIG. 4 shows movable section 50 to be at the distal end of the head, the movable section(s) could be located at any desired location on the head.

What is claimed is:

1. A toothbrush comprising:

a handle;

a head secured to the handle, the head including a base having an upstanding wall extending from at least a portion of the base to create a frame;

a membrane attached to the upstanding wall along a periphery of the membrane, the membrane including a plurality of interconnected generally circular aligned sections, each generally circular aligned section having a width extending in a transverse direction of the head, the widths of the generally circular sections progressively decreasing in size in a longitudinal direction extending from the handle to a tip of the head of the toothbrush; and a plurality of first cleaning elements disposed on the membrane in the generally circular aligned sections, the cleaning elements extending away from the head;

wherein the membrane is capable of flexing to alter its original orientation during use of said toothbrush and then recovering to assume its original orientation randomly during use of said toothbrush.

2. The toothbrush of claim 1 wherein at least one of the first cleaning elements comprises a bristle secured to the membrane by in-molded technology.

3. The toothbrush of claim 1 wherein the first cleaning elements includes at least two generally circular arrangements of bristles disposed in two of the plurality of generally circular sections, respectively.

4. The toothbrush of claim 1 wherein at least one additional cleaning element is fixed in a non-flexible position in the head.

5. The toothbrush of claim 1 wherein a plurality of second cleaning elements is arranged in a fixed position in the head extending away from the head at a different height than the first cleaning elements on the membrane.

6. The toothbrush of claim 5, wherein one of the cleaning elements in the at least one pair of cleaning elements comprises an elastomeric material.

7. The toothbrush of claim 1 wherein the membrane extends substantially into the handle.

8. The toothbrush of claim 1 further comprising a grip pad provided on the handle.

9. The toothbrush of claim 8 wherein the membrane extends from the head to the grip pad.

10. The toothbrush of claim 9 wherein the membrane covers the grip pad.

11. The toothbrush of claim 1, wherein at least one of the first cleaning elements comprises an elastomeric material.

12. The toothbrush of claim 1, wherein the plurality of generally circular aligned sections include a first generally circular aligned section having a first width extending in a transverse direction of the head, a second generally circular aligned section having a second width extending in a transverse direction of the head, and a third generally circular aligned section having a third width extending in a transverse direction of the head, the first, second and third widths being of decreasing size in the longitudinal direction extending from the handle to a tip of the head of the toothbrush.

13. The toothbrush of claim 12, wherein the first cleaning elements include a first group of cleaning elements disposed in the first generally circular aligned section and a second group of cleaning elements disposed in the second generally circular aligned section, the first and second groups of cleaning elements creating a first space between the first and second generally circular aligned sections, a portion of the membrane being disposed in the first space and having a width extending in a transverse direction of the head having a smaller size than the first and second widths.

14. The toothbrush of claim 13, further comprising second cleaning elements fixed in a non-flexible position in the first space.

15. The toothbrush of claim 14, wherein the second cleaning elements have a length longer than the first cleaning elements.

16. The toothbrush of claim 14, wherein the second cleaning elements include a pair of cleaning elements.

17. The toothbrush of claim 16, further comprising a second pair of second cleaning elements fixed in a non-flexible position in a second space formed between the second and third generally circular aligned sections.

18. The toothbrush of claim 1, wherein the toothbrush includes a single longitudinal row of generally circular aligned sections extending from the handle to the tip of the head of the toothbrush without including other generally circular sections.

* * * * *